US011203485B2

(12) United States Patent
Shek

(10) Patent No.: US 11,203,485 B2
(45) Date of Patent: Dec. 21, 2021

(54) LID OF GARBAGE CONTAINER

(71) Applicant: Michael Shek, San Mateo, CA (US)

(72) Inventor: Michael Shek, San Mateo, CA (US)

( * ) Notice: Subject to any disclaimer, the term of this patent is extended or adjusted under 35 U.S.C. 154(b) by 181 days.

(21) Appl. No.: 16/554,270

(22) Filed: Aug. 28, 2019

(65) Prior Publication Data

US 2021/0061558 A1 Mar. 4, 2021

(51) Int. Cl.
*B65F 1/16* (2006.01)

(52) U.S. Cl.
CPC ..... *B65F 1/1638* (2013.01); *B65F 1/1615* (2013.01)

(58) Field of Classification Search
CPC ..... B65F 1/1638; B65F 1/1615; B65F 1/141; B65F 1/1646; B65F 2210/168; B65F 2240/164
USPC ..... 220/826, 263, 260
See application file for complete search history.

(56) References Cited

U.S. PATENT DOCUMENTS

2002/0056997 A1* 5/2002 Bassi ..... E05C 3/24 292/226
2009/0045198 A1* 2/2009 Kao ..... B65F 1/06 220/260
2013/0233857 A1* 9/2013 Yang ..... B65F 1/04 220/495.08
2013/0298506 A1* 11/2013 Lucas ..... B65B 1/02 53/452
2015/0035288 A1* 2/2015 Fink ..... B65F 1/1615 292/2
2019/0009982 A1* 1/2019 Lu ..... B65F 1/163
2019/0270586 A1* 9/2019 Lovingood ..... B65F 1/1638
2020/0354988 A1* 11/2020 Dirnberger ..... E05B 9/02

* cited by examiner

*Primary Examiner* — J. Gregory Pickett
*Assistant Examiner* — Niki M Eloshway
(74) *Attorney, Agent, or Firm* — Muncy, Geissler, Olds & Lowe, P.C.

(57) ABSTRACT

A lid of a garbage container is provided, including: a main body, an opening and closing system and a locking device. The main body includes an input opening. The opening and closing system is disposed on the main body and includes a lid member and a driving unit. The lid member is disposed on the main body and openably covers the input opening. The driving unit drives the lid member to move along a moving path and uncover the input opening. The locking device includes a blocking member disposed on the main body. The blocking member is configured to be externally operable and movable between a locking position and a releasing position. When the blocking member is in the locking position, the blocking member is on the moving path and at least partially interferes with and blocks the lid member.

9 Claims, 5 Drawing Sheets

LID OF GARBAGE CONTAINER

BACKGROUND OF THE INVENTION

Field of the Invention

The present invention relates to a garbage container, especially to a lid of the garbage container.

Description of the Prior Art

Generally, a container such as a barrel body is used to receive garbage, and the garbage is dumped until the barrel body is full. The barrel body is covered by a lid member so as to prevent odor of the garbage from emanating therefrom, block insects from entering therein and avoid rummaging by animals. However, hands of a user often get dirty, or the user must free up his/her hands to open the lid member, which is inconvenient. Hence, a sensing lid for a garbage container is developed, and the problems as described above are solved by automatically closing and opening the lid.

However, the sensing lid is easy to be actuated and opened when objects, people or pets pass through a sensing area of the sensing lid, which results in unnecessary actuation of the lid member so that the odor of the garbage is easy to emanate from the garbage container.

The present invention is, therefore, arisen to obviate or at least mitigate the above-mentioned disadvantages.

SUMMARY OF THE INVENTION

The main object of the present invention is to provide a lid of a garbage container which is automatically openable and is kept closed without unexpected opening due to unexpected external actuation.

To achieve the above and other objects, the present invention provides a lid of a garbage container, configured to be assembled on a barrel body and define a receiving space with the barrel body, the lid of the garbage container including: a main body, an opening and closing system and a locking device. The main body includes an input opening configured to be communicated with the receiving space. The opening and closing system is disposed on the main body and includes a lid member, a processing unit, a sensing unit and a driving unit. The lid member is disposed on the main body and openably covers the input opening. The sensing unit is electrically connected with the processing unit. The driving unit is electrically connected between the processing unit and the lid member. The sensing unit is activatable, from an outside of the garbage container, to transmit an actuation signal to the processing unit. The processing unit receives the actuation signal and drives the driving unit, and the driving unit drives the lid member to move along a moving path and uncover the input opening. The locking device includes a blocking member disposed on the main body, and the blocking member is configured to be externally operable and movable between a locking position and a releasing position. When the blocking member is in the locking position, the blocking member is on the moving path and at least partially interferes with and blocks the lid member; when the blocking member is in the releasing position, the blocking member is off the moving path and free of interference and non-blocking with the lid member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
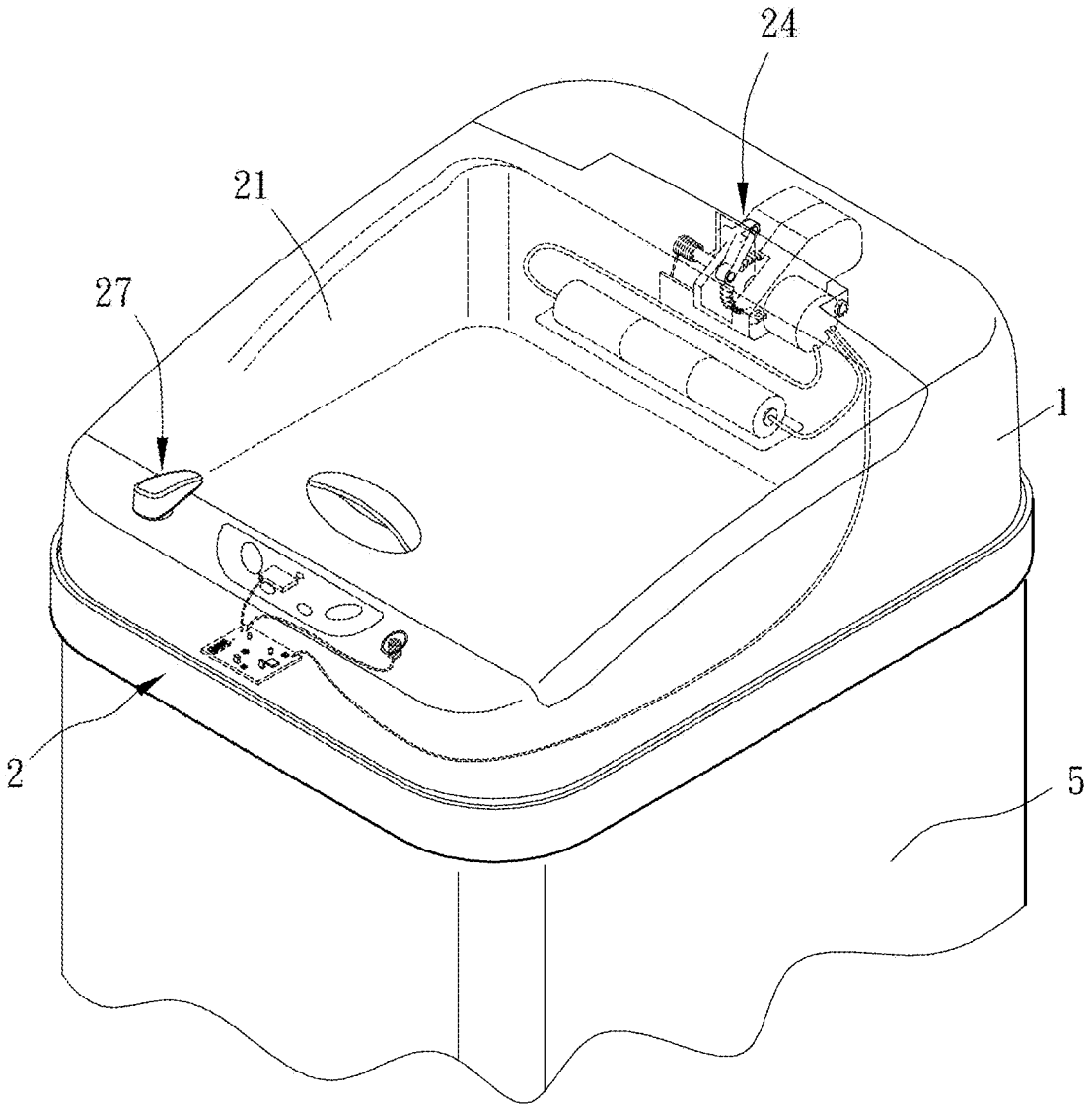
FIG. 1 is a stereogram of a preferable embodiment of the present invention when a blocking member is in a locking position.
Figure 2:
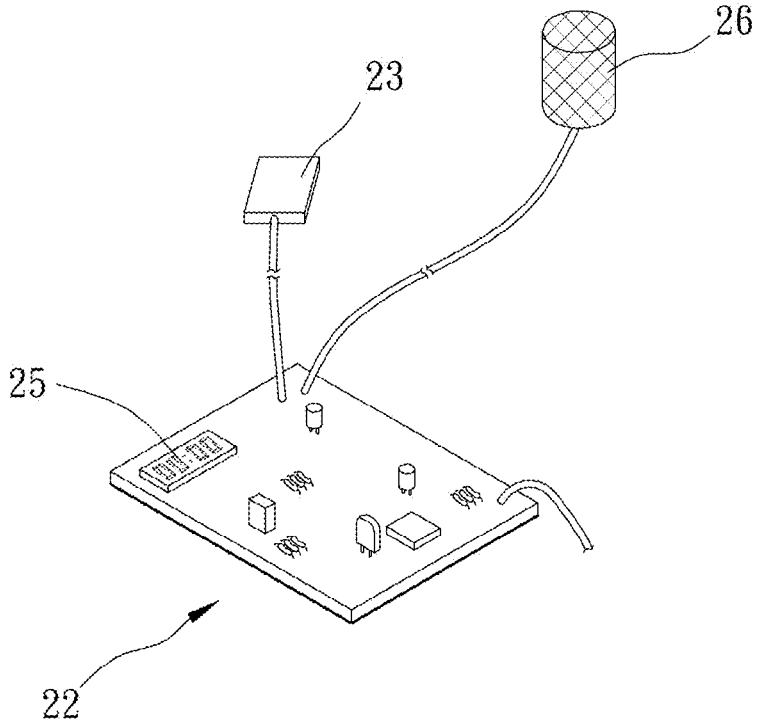
FIG. 2 is a partial enlargement of FIG. 1.
Figure 3:
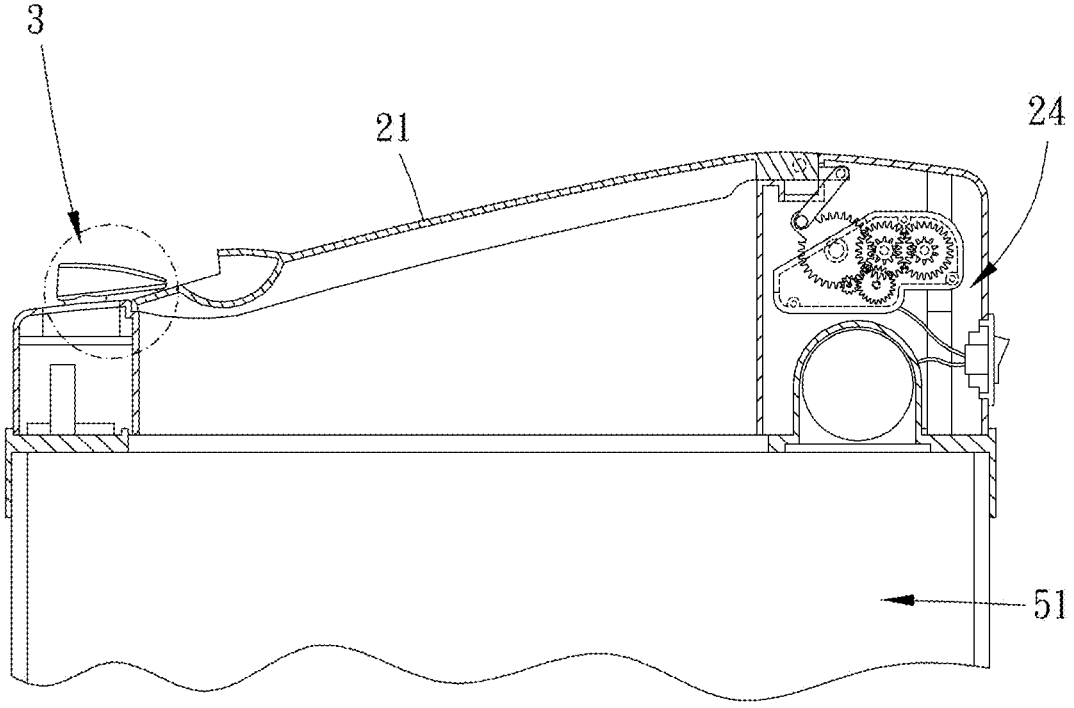
FIG. 3 is a cross-sectional view of FIG. 1.
Figure 4:
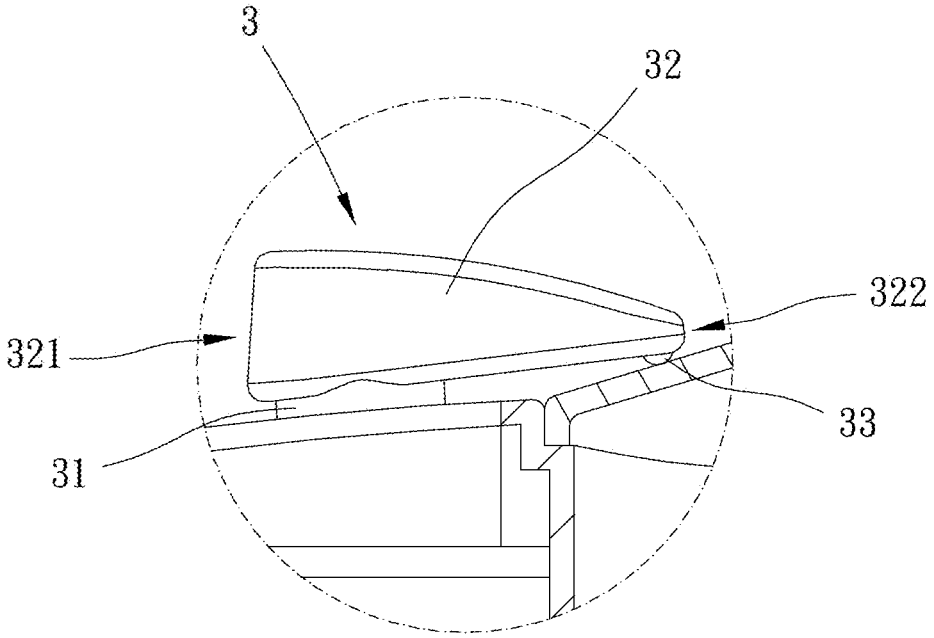
FIG. 4 is a partial enlargement of FIG. 3.
Figure 5:
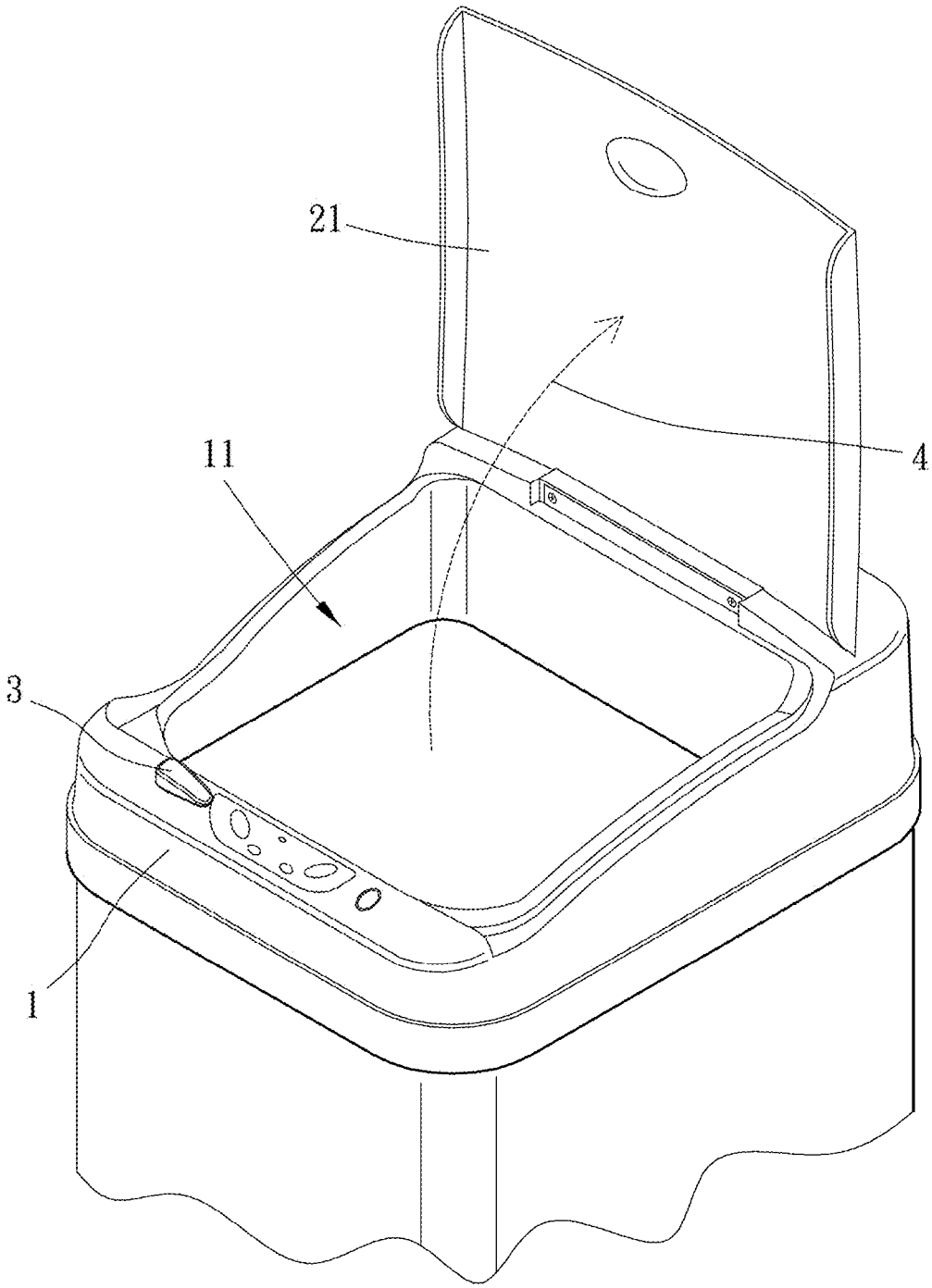
FIG. 5 is a stereogram of a preferable embodiment of the present invention when the blocking member is in a releasing position.

Please refer to FIGS. 1 to 5 for a preferable embodiment of the present invention. A lid of a garbage container of the present invention is configured to be assembled on a barrel body 5 and define a receiving space 51 with the barrel body 5. The lid of a garbage container includes a main body 1, an opening and closing system 2 and a locking device 27.

The main body 1 includes an input opening 11 configured to be communicated with the receiving space 51 for receiving garbage. The opening and closing system 2 is disposed on the main body 1 and includes a lid member 21, a processing unit 22, a sensing unit 23 and a driving unit 24.

The lid member 21 is disposed on the main body 1 and openably covers the input opening 11 so as to block insects from entering the garbage container and prevent odor of the garbage emanating out of the receiving space 51. The sensing unit 23 is electrically connected with the processing unit 22, and the driving unit 24 is electrically connected between the processing unit 22 and the lid member 21. The sensing unit 23 is activatable, from an outside of the garbage container, to transmit an actuation signal to the processing unit 22. The processing unit 22 receives the actuation signal and drives the driving unit 24, and the driving unit 24 drives the lid member 21 to move along a moving path 4 and uncover the input opening 11. The sensing unit 23 may be a distance sensor configured to detect a distance from an object to the lid member 21, wherein the sensing unit 23 may be an optical sensor, magnetic sensor, ultrasonic sensor or the like.

The locking device 27 includes a blocking member 3 disposed on the main body 1, and the blocking member 3 is configured to be externally operable and movable between a locking position and a releasing position. when the blocking member 3 is in the locking position, the blocking member 3 is on the moving path 4 and at least partially interferes with and blocks the lid member 21. When the blocking member 3 is in the releasing position, the blocking member 3 is off the moving path 4 and free of interference and non-blocking with the lid member 21. Therefore, the blocking member 3 interferes with and blocks the lid member 21 when the garbage container is not in use so that the lid member 21 will not be opened even if the sensing unit 23 detects an object passing thereby.

In this embodiment, the blocking member 3 is swingably disposed on the main body 1 and swingable between the locking position and the releasing position so that the blocking member 3 is easy to control and quickly switch to different positions. Specifically, the blocking member 3 includes a shaft 31 and a blocking portion 32. The shaft 31 is rotatably disposed on the main body 1, and the blocking portion 32 is transversely disposed on the shaft 31. The blocking portion 32 is rotatable about the shaft 31. When the blocking member 3 is in the locking position, the blocking portion 32 is on the moving path 4 to block the lid member 21. In other embodiments, the blocking member may interfere with and block the lid member by any mechanical means.

Preferably, the blocking member 3 further includes an abutting portion 33, and the abutting portion 33 is protrudingly disposed on the blocking portion 32. When the blocking member 3 is in the locking position, the abutting portion 33 is abutted against the lid member 21 so that the lid member 21 is unmovable and keep covering the input opening 11. The blocking portion 32 includes a first end 321 connected with the shaft 31 and a second end 322 connected with the abutting portion 33, and the blocking portion 32 is tapered in a direction from the first end 321 toward the second end 322.

The abutting portion 33 is preferably shaped as arcuate convex. When the blocking member 3 is swinging, the abutting portion 33 is smoothly and slidably abutted against a surface of the lid member 21 so as to provide smooth movement of the abutting portion 33 and keep surface integrity of the lid member 21.

Preferably, the shaft 31, the blocking portion 32 and the abutting portion 33 are integrally formed of one piece so as to have preferable structural strength.

After the blocking member 3 blocks the lid member 21, it is necessary to provide a protection mechanism for preventing the driving unit 24 from continuously operating.

In this embodiment, the opening and closing system 2 further includes a timing unit 25 which is electrically connected to the processing unit 22. The timing unit 25 is actuatable by the processing unit 22. When the driving unit 24 drives the lid member 21, the timing unit 25 starts and counts to a preset time, and the processing unit 22 transmits a stop signal to stop the driving unit 24. When the blocking member 3 is in the locking position and abutted against the lid member 21, the driving unit 24 is operable during the preset time. For example, if the preset time is 2 second, the driving unit 24 stops operating after a period of 2 seconds so as to avoid overheating, overload or damage of the driving unit 24.

Preferably, the opening and closing system 2 further includes a warning unit 26 which is electrically connected to the processing unit 22. When the driving unit 24 received the stop signal, the processing unit 22 actuates the warning unit 26 so as to remind a user of that an object passes thereby when the blocking member 3 is in the locking position. Therefore, the user can determine whether to change a position of the blocking member 3 or switch off a power supply of the driving unit 24, and the user may determine whether the sensing unit 23 is operable. The warning unit 26 includes at least one of a light-emitting element, a sound-producing element and a display element.

Figure 6:
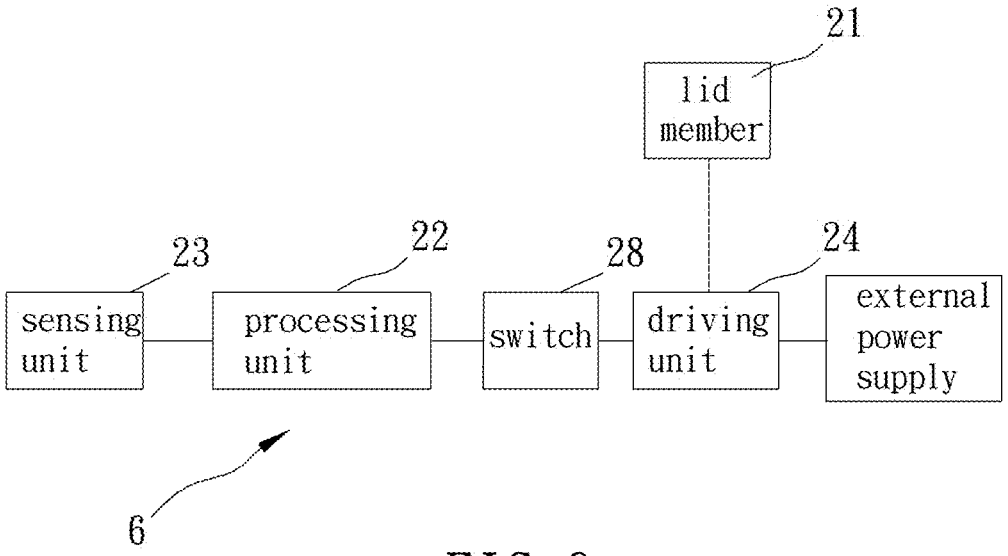
FIG. 6 is a block diagram of another preferable embodiment of the present invention.

Please refer to FIG. 6 which shown another embodiment of the present invention. The locking device 27 further includes a switch 28, and the sensing unit 23, the processing unit 22, the driving unit 24 and an external power supply are electrically connected to one another to form a circuit 6. The switch 28 and the blocking member 3 are comovable with each other, and the switch 28 is electrically connected with the circuit 6. When the blocking member 3 is in the locking position, the switch 28 switches off the circuit 6 and the driving unit 24 is non-operable so that the lid member 21 is unmovable. When the blocking member 3 is in the releasing position, the switch 28 switches on the circuit 6 and the driving unit 24 is operable.

For example, the switch 28 is electrically connected between the driving unit 24 and the processing unit 22. When the blocking member 3 is in the locking position, the switch 28 disconnects the circuit 6 and the driving unit 24 and the processing unit 22 are uncommunicative with each other. When the blocking member 3 is in the releasing position, the switch 28 connects the circuit and the driving unit 24 and the processing unit 22 are communicative with each other.

In summary, the locking device blocks the lid member when the garbage container is not in use, which can effectively prevent the lid member from unnecessary actuation so as to reduce opening times of the lid member and prevent the odor of the garbage from emanating from the garbage container.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A lid of a garbage container, configured to be assembled on a barrel body and define a receiving space with the barrel body, the lid of the garbage container including:

a main body, including an input opening configured to be communicated with the receiving space;

an opening and closing system, disposed on the main body, including a lid member, a processing unit, a sensing unit and a driving unit, the lid member being disposed on the main body and openably covering the input opening, the sensing unit being electrically connected with the processing unit, the driving unit being electrically connected between the processing unit and the lid member, the sensing unit being activatable, from an outside of the garbage container, to transmit an actuation signal to the processing unit, the processing unit receiving the actuation signal and driving the driving unit, the driving unit driving the lid member to move along a moving path and uncover the input opening;

a locking device, including a blocking member disposed on the main body, the blocking member configured to be externally operable and movable between a locking position and a releasing position, wherein when the blocking member is in the locking position, the blocking member is on the moving path and at least partially interferes with and blocks the lid member; when the blocking member is in the releasing position, the blocking member is off the moving path and free of interference and non-blocking with the lid member;

wherein the opening and closing system further includes a timing unit which is electrically connected to the processing unit, the timing unit is actuatable by the processing unit, when the driving unit drives the lid member, the timing unit starts and counts to a preset time, and the processing unit transmits a stop signal to stop the driving unit.

2. The lid of the garbage container of claim 1, wherein the locking device further includes a switch, the sensing unit, the processing unit, the driving unit and an external power supply are electrically connected to one another to form a circuit, the switch and the blocking member are comovable with each other, and the switch is electrically connected with the circuit; when the blocking member is in the locking position, the switch switches off the circuit and the driving unit is non-operable; when the blocking member is in the releasing position, the switch switches on the circuit and the driving unit is operable.

3. The lid of the garbage container of claim 1, wherein the opening and closing system further includes a warning unit which is electrically connected to the processing unit, and when the driving unit received the stop signal, the processing unit actuates the warning unit.

4. The lid of the garbage container of claim 3, wherein the warning unit includes at least one of a light-emitting element, a sound-producing element and a display element.

5. The lid of the garbage container of claim 4, wherein the blocking member is swingably disposed on the main body and swingable between the locking position and the releasing position; the blocking member includes a shaft and a blocking portion, the shaft is rotatably disposed on the main body, the blocking portion is transversely disposed on the shaft, the blocking portion is rotatable about the shaft, when the blocking member is in the locking position, the blocking portion is on the moving path to block the lid member; the blocking member further includes an abutting portion, the abutting portion is protrudingly disposed on the blocking portion, and the abutting portion is abutted against the lid member when the blocking member is in the locking position; the shaft, the blocking portion and the abutting portion are integrally formed of one piece; the preset time is 2 second; the abutting portion is shaped as arcuate convex; the blocking portion includes a first end connected with the shaft and a second end connected with the abutting portion, and the blocking portion is tapered in a direction from the first end toward the second end.

6. The lid of the garbage container of claim 1, wherein the blocking member is swingably disposed on the main body and swingable between the locking position and the releasing position.

7. A lid of a garbage container, configured to be assembled on a barrel body and define a receiving space with the barrel body, the lid of the garbage container including:

a main body, including an input opening configured to be communicated with the receiving space;

an opening and closing system, disposed on the main body, including a lid member, a processing unit, a sensing unit and a driving unit, the lid member being disposed on the main body and openably covering the input opening, the sensing unit being electrically connected with the processing unit, the driving unit being electrically connected between the processing unit and the lid member, the sensing unit being activatable, from an outside of the garbage container, to transmit an actuation signal to the processing unit, the processing unit receiving the actuation signal and driving the driving unit, the driving unit driving the lid member to move along a moving path and uncover the input opening;

a locking device, including a blocking member disposed on the main body, the blocking member configured to be externally operable and movable between a locking position and a releasing position, wherein when the blocking member is in the locking position, the blocking member is on the moving path and at least partially interferes with and blocks the lid member; when the blocking member is in the releasing position, the blocking member is off the moving path and free of interference and non-blocking with the lid member;

wherein the blocking member is swingably disposed on the main body and swingable between the locking position and the releasing position;

wherein the blocking member includes a shaft and a blocking portion, the shaft is rotatably disposed on the main body, the blocking portion is transversely disposed on the shaft, the blocking portion is rotatable about the shaft, when the blocking member is in the locking position, the blocking portion is on the moving path to block the lid member.

8. The lid of the garbage container of claim 7, wherein the blocking member further includes an abutting portion, the abutting portion is protrudingly disposed on the blocking portion, and the abutting portion is abutted against the lid member when the blocking member is in the locking position.

9. The lid of the garbage container of claim 8, wherein the shaft, the blocking portion and the abutting portion are integrally formed of one piece.

* * * * *